United States Patent [19]

van der Laan

[11] 4,191,124

[45] Mar. 4, 1980

[54] DOCKSHIP

[75] Inventor: Berend van der Laan, Schiedam, Netherlands

[73] Assignee: Scheepvaartbedrijf "Con Brio" N.V., Emmastad, Curacao, Netherlands Antilles

[21] Appl. No.: 889,574

[22] Filed: Mar. 23, 1978

[30] Foreign Application Priority Data

Mar. 25, 1977 [NL] Netherlands ..... 7703249

[51] Int. Cl.[2] ..... B63B43/14

[52] U.S. Cl. ..... 114/123; 114/201 R; 114/219; 114/72

[58] Field of Search ..... 405/3-6; 114/45-48, 72, 73, 76, 78, 85, 116, 26, 27, 173, 174, 121, 123, 201 R-203, 258-260

[56] References Cited

U.S. PATENT DOCUMENTS

| | | | |
|---|---|---|---|
| 14,113 | 1/1856 | Perley | 114/173 |
| 2,564,051 | 10/1951 | Bush | 114/201 |
| 3,133,420 | 5/1964 | Burnett | 405/6 |
| 3,198,157 | 8/1965 | Livas | 114/123 |
| 3,380,422 | 4/1968 | Bachko | 114/72 |
| 3,913,512 | 10/1975 | Kirby | 114/260 |

*Primary Examiner*—Edward R. Kazenske
*Assistant Examiner*—D. W. Keen
*Attorney, Agent, or Firm*—Sughrue, Rothwell, Mion, Zinn and Macpeak

[57] ABSTRACT

A dockship with a large hold arranged for the transport of heavy cargo loads, and provided with hatch covers which have buoyancy and which are adapted to be swung alongside the sides of the ship particularly when loading and unloading heavy cargo loads, to increase the ship's beam and stability.

7 Claims, 6 Drawing Figures

DOCKSHIP

BACKGROUND OF THE INVENTION

This invention relates to a dockship, provided with an open hold extending from the forepeak bulkhead to a sterngate, arranged for the transport of heavy cargo loads such as reactor vessels which are to be loaded and unloaded by a gantry crane running on double boards forming structural strength members, or lighters which, when the sterngate is opened and the ship is submerged, can float in and out, and at least the upper portion of each of the double boards forming a buoyancy chamber, and said hold being provided with hatch covers.

The double boards, in which the buoyancy chambers are formed, have previously been constructed relatively wide in order to give the ship, particularly when loading and unloading heavy objects, sufficient stability, but the disadvantage thereof is that this is at the cost of the paying hold area.

SUMMARY OF THE INVENTION

The present invention eliminates said disadvantage by the use of high box-shaped watertight hatch covers which are adapted to be moved to outside positions along the boards to serve as buoyancy chests.

When the hatches are opened, the hatch covers can now be used to increase the ship's stability, whereby it becomes possible to proportionally reduce the width of the double sideboards and to increase the paying hold area while maintaining the buoyancy and stability.

The preferred embodiment is characterized in that the hatch covers are mounted with their width which on the hatch opening represents their dimension in the longitudinal direction of the ship, in height direction on the board walls, and in that the hatch covers are chamfered at one, alternately opposite side, and are mounted on the board walls with said chamfer placed at the bottom and at the outer side, and further aspects are that the hatch covers forming the buoyancy chests are secured between two fenders on the board walls, and that the lower fender forms a cradle support and the upper fender a retaining support for the hatch covers, and furthermore that the hatch covers are handled by means of a pair of cranes arranged at each side of the gantry crane. The handling is facilitated due to the aspect that the hatch covers are positioned with a centrally arranged slot therein on a turning-canting support at the top of each board wall, and are then successively turned in a horizontal plane over 90°, and canted in a vertical plane over 90° about the board edge.

The provided arrangements make it possible to increase the hold capacity by 25%, as a dockship having a beam of 24 m, for which thus far for a sufficient stability double boards of each 4 m width are required, whereby a hold beam of only 16 m width remained, by laterally arranging hatch covers with a height of 2 m, as buoyancy chests, thereby reducing the width of each of the boards to 2 m, can now have a hold beam of 20 m.

The now dockship is further characterized by an articulated sterngate, of which the lower articulated section extends to above the quay height and the upper articulated section is adapted to serve as a ramp. Due to this it is not necessary to each time lay out a separate loose ramp between the quay and the ship, which loose ramp, if the ship is right under the quayside, would moreover project into the ship, whereas the swung-out sterngate, serving as a ramp, now projects outside the ship, so that for this purpose no useful hold area has to be kept free.

A further aspect is that the otherwise entirely unobstructed open hold is to be subdivided by a displaceable transverse bulkhead which is adapted to form amidships a separating wall between a fore hold compartment to be kept dry and an aft hold compartment which is submerged when the sterngate is opened, and when arranged abaft can serve as afterpeak bulkhead ahead of the sterngate. The positioning is simple, due to the fact that the transverse bulkhead has edges provided with a sloping chamfer to be pressed under waterpressure watertight onto mating sloping abutting edges which are secured on the walls of the hold to submerged attaching means.

The invention is described in more detail in the following specification with reference to the drawing, in which the invention is illustrated.

DESCRIPTION OF THE PREFERRED EMBODIMENT

Figure 1:
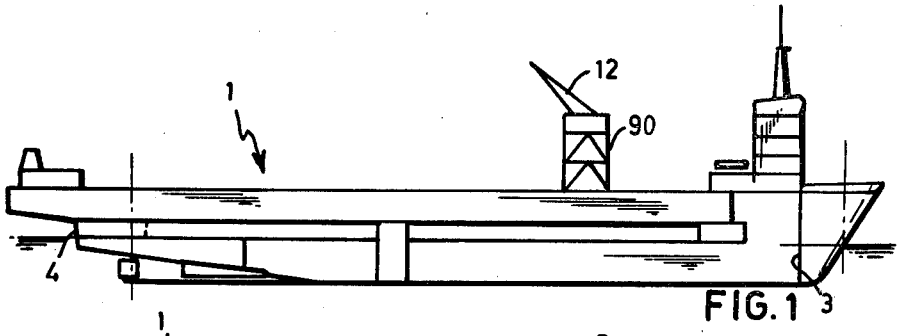
FIG. 1 is a side view of a dockship.
Figure 2:
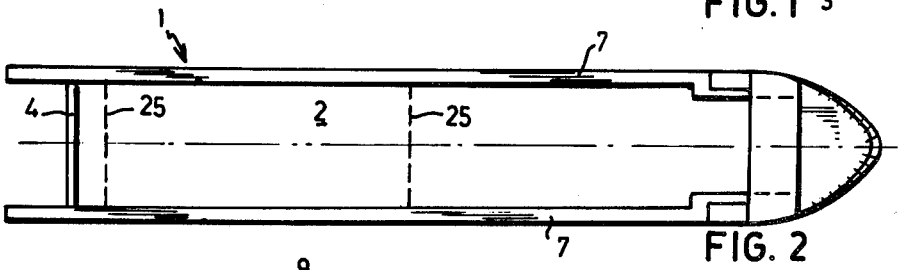
FIG. 2 is a plan view of the ship.
Figure 3:
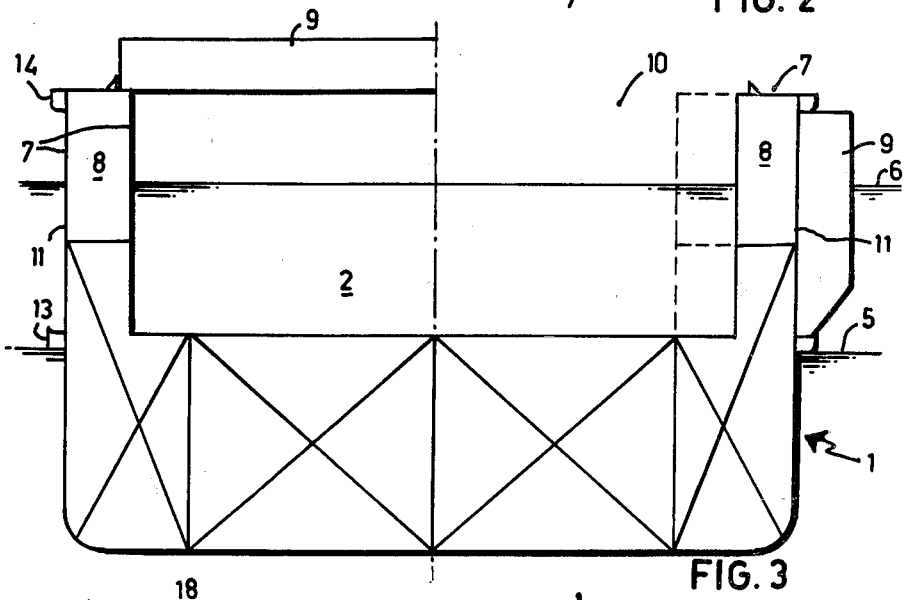
FIG. 3 is a transverse section amidships, on a larger scale.
Figure 4:
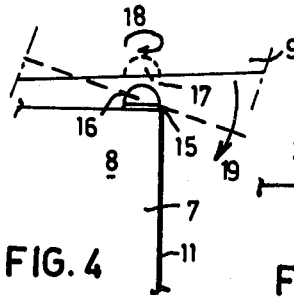
FIG. 4 is a schematic detail view of a turning-canting support on the board edge.

The dockship 1 shown in FIGS. 1–3 has an open unobstructed hold 2 extending from the forepeak bulkhead 3 to a sterngate 4. When the sterngate 4 is opened, the ship is submerged deeper abaft, whereby lighters can be towed into and out of the submerged hold 2 through the opened gate. The draught when the sterngate is closed is indicated at 5 in FIG. 3, and at 6 when the sterngate is opened in the submerged condition.

Running on the double sideboards 7, of which the upper portion forms a buoyancy chamber 8, is a gantry crane 90 shown in FIG. 1, whereby also dry loading and unloading of heavy cargo loads such as large boilers and similar objects can take place.

Thus far in view of the stability a relatively large width of the double boards 7 with their buoyancy chambers 8 was required, as indicated by dotted lines at the right-hand side in FIG. 3.

According to the invention said width is considerably reduced, as represented in full lines in FIG. 3, by the use of high box-shaped watertight hatch covers 9 which are adapted to be mounted outside along the boards 7 to serve as buoyancy chests, whereby the buoyancy chambers 8 in the boards 7 can be smaller than was previously possible.

In the left half of FIG. 3 the hatch covers 9 are shown on the hatch opening 10 over the hold 2; in the right half of FIG. 3 the hatch covers 9 are removed from the hatch opening 10 and arranged in series outside along the board walls 11 by means of a crane 12 shown in FIG. 1, of which one is located at each side of the gantry crane 90. The hatch covers 9 are fixed between a lower fender 13 which is formed as a cradle support, and an upper fender 14 serving as a retaining support.

To facilitate the mounting of the hatch covers 9 outside on the board walls 11 turning-canting supports 16 are arranged on the board edge 15 at spacings corresponding with the hatch cover height, on which the hatch covers are positioned with a centrally arranged slot 17 therein, and turned according to the arrows 18 and 19 in a horizontal plane over 90°, and then canted in a vertical plane over 90° about the board edge 15 by means of a tackle (not shown) to the crane 12.

Floating into and out of the hold 2 or simply hoisting the watertight hatch covers 9 overboard are further possibilities which are intended.

Figure 5:
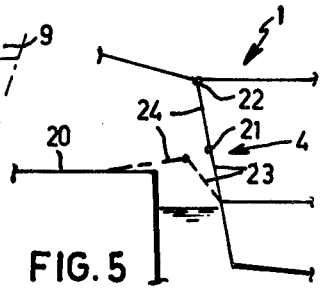
FIG. 5 is a view of an articulated sterngate.
Figure 6:
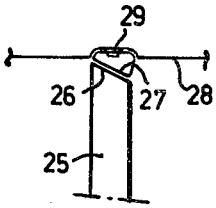
FIG. 6 is a detail view in section of the securing of a transverse bulkhead to be mounted in the hold.

FIG. 5 shows the dockship 1 with the sterngate 4 laying before a quay 20. The sterngate 4 is divided by a lower hinge 21 and an upper hinge 22 in two articulated sections 23, 24. The lower articulated section 23 extends to above the quay height and the upper articulated section 24 forms in swung-out condition as represented in dotted lines a ramp. When transporting dry cargo the lower articulated section 23 of the sterngate 4 should be closed, as when driving the gantry crane 90 rearwardly the ship trims down aft and the deck of the hold 2 may get below the water level but should not have water standing on it. When transporting wet cargo i.e. lighters which have to be towed in and out, the lower articulated section 23 is also opened. As represented in FIG. 2, the hold 2 is equipped with a displaceable transverse bulkhead 25. When it is arranged amidships, the hold 2 is thereby subdivided in a dry fore compartment and a submerged aft compartment when the sterngate 4 is opened, whereby various types of cargo can be taken aboard. Arranged abaft, the transverse bulkhead 25 can serve as afterpeak bulkhead. FIG. 6 shows the way of mounting said transverse bulkhead 25 which has chamfered side walls 26 and is pressed by waterpressure onto mating chamfered mounting posts 27 fixed by securing means 29 which are recessed in the walls 28 of the hold 2.

What is claimed is:

1. A dockship having an open hold extending from a forepeak bulkhead to a sterngate, for the transport of heavy cargo loads such as reactor vessels loaded and unloaded by a gantry crane running on double sideboards of the ship which form structural strength members, or lighters which can float in and out when the sterngate is opened and the ship is submerged, at least the upper portion of each of the double sideboards forming a buoyancy chamber, and said hold being provided with hatch covers, characterized by: (a) the hatch covers having a relatively thick, rectangular configuration and being watertight and buoyant, (b) two vertically spaced fenders mounted on each of the sideboard outer walls, and (c) the hatch covers being movable from their closed positions in which their width dimension is defined as lying in the longitudinal direction of the ship to opened positions wherein they are mounted in series along the upper portions of the outer walls of the sideboards between the fenders to function as buoyancy chambers, with their width dimension lying in a vertical direction.

2. A dockship according to claim 1, wherein the hatch covers are each chamfered at one, alternately opposide side edge, and are mounted on the sideboard walls with said chamfer disposed at the bottom and at the outer side adjacent a lower one of the two fenders.

3. A dockship according to claim 2, characterized in that the lower fender forms a cradle support and an upper one of the two fenders forms a retaining support for the hatch covers.

4. A dockship according to claim 1, wherein the hatch covers are handled by a pair of cranes arranged at each side of the gantry crane.

5. A dockship according to claim 1, wherein the hatch covers each have a centrally arranged slot therein positioned on a turning-canting support at the top of each sideboard wall, and are successively rotated in a horizontal plane through 90°, and canted in a vertical plane through 90° about the sideboard edge in moving from their closed to buoyancy positions.

6. A dockship according to claim 1, characterized by an articulated sterngate, having a lower articulated section extending to above a quay height and an upper articulated section adapted to serve as a loading and unloading ramp.

7. A dockship according to claim 1, characterized by a displaceable transverse bulkhead adapted to form amidships a separating wall between a fore hold compartment to be kept dry and an aft hold compartment which is submerged when the sterngate is opened, movable abaft to serve as an afterpeak bulkhead of the sterngate, and having edges provided with a sloping chamfer to be urged under waterpressure against mating sloping abutting edges secured on walls of the hold to submerged attaching means.

* * * * *